US006493526B2

(12) United States Patent
Sato

(10) Patent No.: US 6,493,526 B2
(45) Date of Patent: Dec. 10, 2002

(54) RESTORATION METHOD FOR A CHARGING ROLLER, A CHARGING ROLLER RESTORED BY THE METHOD AND A PROCESS CARTRIDGE INSTALLED IN THE RESTORED CHARGING ROLLER

(75) Inventor: Masamichi Sato, Saitama (JP)

(73) Assignee: Keytech Co., Ltd., Tokyo (JP)

( * ) Notice: Subject to any disclaimer, the term of this patent is extended or adjusted under 35 U.S.C. 154(b) by 0 days.

(21) Appl. No.: 09/929,056

(22) Filed: Aug. 15, 2001

(65) Prior Publication Data

US 2002/0054772 A1 May 9, 2002

(30) Foreign Application Priority Data

Nov. 9, 2000 (JP) ..... 2000-381095

(51) Int. Cl.[7] ..... G03G 15/02

(52) U.S. Cl. ..... 399/109; 29/402.01; 29/895.1; 399/176

(58) Field of Search ..... 399/109, 115, 399/176, 174; 361/221, 225, 214; 29/895.1, 402.01, 402.03, 402.04, 402.09

(56) References Cited

U.S. PATENT DOCUMENTS 5,543,899 A * 8/1996 Inami et al. ..... 399/176
6,374,071 B1 * 4/2002 Sato ..... 399/174

FOREIGN PATENT DOCUMENTS

JP 05-273844 10/1993
JP 08-171259 7/1996

* cited by examiner

*Primary Examiner*—Sophia S. Chen
(74) *Attorney, Agent, or Firm*—Young & Thompson

(57) ABSTRACT

A charging roller is constituted of a shaft, a conductive elastic cylinder, and a charging layer. The shaft is integrally covered with the conductive elastic cylinder. Further, the conductive elastic cylinder is integrally covered with the charging layer. The charging roller formed in this way is restored such that it is loosely encased in a seamless charging tube having semi-conductivity.

24 Claims, 2 Drawing Sheets

RESTORATION METHOD FOR A CHARGING ROLLER, A CHARGING ROLLER RESTORED BY THE METHOD AND A PROCESS CARTRIDGE INSTALLED IN THE RESTORED CHARGING ROLLER

BACKGROUND OF THE INVENTION

1. Field of the Invention

The present invention relates to a restoration method for a charging roller used for an electrophotographic apparatus. In the apparatus, a voltage-applied charging layer which forms the surface layer of the charging roller comes into contact with a member to be charged, by which the surface of this member is charged to a predetermined surface potential. The present invention further relates to a charging roller restored by the present invention. The present invention further relates to a process cartridge installed in a charging roller restored by the present invention.

2. Description of the Prior Art

As shown in FIG. 3, a charging roller is usually constituted of a conductive shaft 1, a conductive elastic cylinder 2, and a charging layer 3. The conductive elastic cylinder 2 is made of a conductive rubber, a conductive foamed material or the like, and is integrally formed on the conductive shaft 1. Further, the charging layer 3 is integrally provided on a peripheral surface of the conductive elastic cylinder 2. The charging layer 3 is provided as a thin layer by means of a dip-coating method, a spray coating method, and so forth. Alternatively, the peripheral surface of the conductive elastic cylinder 2 may be tightly covered with a seamless heat shrink charging tube.

Such a charging roller is used so as to come into contact with a member to be charged, which is a photosensitive drum for example. Due to the rubbing contact, a developing agent sometimes adheres to the surface of the charging roller. Moreover, the surface of the charging roller is abraded. In case the developing agent lightly adheres to the charging roller, it is possible to restore the charging roller by wiping the surface thereof with a cloth having absorbed therein an organic solvent such as an alcohol, a ketone and so forth. However, in case the developing agent adheres too strongly to be removed, the charging roller is incapable of being restored and is discarded. Also, in case the surface of the charging roller is scratched during handling and the surface thereof is deteriorated by electric discharge, the charging roller is discarded.

In order to overcome the above conventional problems, Japanese Patent Laid-Open Publication No. 8-171259 discloses a restoration method in which a used charging roller is covered with a seamless heat shrink tube-like charging layer. The Publication No. 8-171259 also discloses another restoration method in which a used charging roller is fitted into a seamless charging tube which forms a charging layer. FIG. 4 is a sectional view of the charging roller restored by the above-mentioned method. In FIG. 4, reference numeral 4 denotes a new charging layer tightly provided on a periphery of the charging roller. According to this method, the seamless charging tube which is to be the new charging layer is integrally attached to the used charging roller by a heat-shrinking method or a force fitting method. In the case of the heat-shrinking method, it is required to prepare a heat-shrinkable tube having an inner diameter larger than the outer diameter of the charging roller. Further, it is required to heat and shrink the heat-shrinkable tube after covering the charging roller. Conducting these steps is costly. In the case of the force fitting method, a seamless charging tube having an inner diameter smaller than the outer diameter of the charging roller is used. When the charging roller is forcibly inserted into the tube, the tube is likely to be damaged because the tube is physically weak. In view of this, practically, the charging roller is inserted into the tube in a state in which air is blown into the tube and the inner diameter thereof is expanded so as to be larger than the outer diameter of the charging roller. Such a process also incurs a considerable cost.

In the restoration method for the charging roller described in the Publication No. 8-171259, the new tube is overlapped on the outermost layer upon each restoration. In actuality, such restoration can be performed only once. The reason for this is that since the electric resistance of the initial charging roller is set so as to have best performance, when the surface of the charging roller is covered with the new tube, the electric resistance changes to shift from the best performance. In practice, this shift from the best performance is imperceptible and hardly causes any problems. However, when a surface of the new tube is further covered with another tube, the shift from the best performance increases. Moreover, the diameter of the restored charging roller is not constant over the entire surface of the charging roller, since the surface of the used charging roller is neither clean nor smooth. Under these conditions, in some cases print quality obtained by using such a charging roller is not acceptable. For example, when a halftone pattern is printed using the charging roller, unevenness arises in the halftone pattern. Also, when printing is conducted in an environment of low humidity and low temperature, a considerable amount of fog may appear on the background of the print.

As to the restoration method for the charging roller described in the Publication No. 8-171259, it has been further found that the following problem arises. When the surface of the charging roller has an uneven portion having a size of about 50 $\mu$m or more (depth or height of about 50 $\mu$m or more, and width (or shorter diameter) of about 50 $\mu$m or more, a print having an uneven portion can be obtained. The reason for this is explained referring to FIG. 5 in which reference numeral 4 denotes a new charging layer provided by a conventional restoration process. The charging layer 4 is formed in such a manner that a heat-shrinkable tube loosely covers the surface of the charging roller to be restored, and then heated to shrink the tube and tightly covers the surface of the charging roller to be restored. At this time, if there is an uneven portion 5 on the surface of the charging roller, a concave portion 6 having a similar shape to the uneven portion 5 is caused on the surface of the restored charging roller, because the heat-shrinkable tube shrinks along the surface of the uneven portion. In FIG. 5, depth of the uneven portion 5 reaches only to the charging layer 3. The uneven portion 5, however, sometimes reaches to the conductive cylinder 2. It was confirmed that when the concave portion 6 was formed, charging was not performed at this portion or charging was not uniformly performed.

In the above, is described the case of the uneven portion having a concave shape. A similar phenomenon also occurs when something adheres to the surface of the charging roller to form a convex shape.

When there is a convex portion on the surface of the restored charging roller, the convex portion always comes into contact with the photosensitive drum strongly. Due to this, the contact portion is locally deteriorated, which shortens the lifetime of the charging roller. It was confirmed that the lifetime of the photosensitive drum was also shortened. Even if the size of the convex portion is about 50 $\mu$m or less and uneven charging is not caused at the beginning, the progressive deterioration causes uneven charging at the convex portion to cause the lifetime to be shortened. When a concave portion is formed on the surface the above-described phenomenon also occurs, since the edge thereof strongly comes into contact with the photosensitive drum.

As stated above, in the conventional restoration method for the charging roller, there are problems in conducting the restoration repeatedly, in conducting it at a low cost, and in obtaining a reproduced charging roller of a high quality.

SUMMARY OF THE INVENTION

In view of the foregoing, it is a primary object of the present invention to provide a restoration method for a charging roller, by which restoration can be performed plural times.

It is a second object of the present invention to provide a restoration method for a charging roller in which restoration can be performed even if an unevenness of about 50 m or more exists on the surface of the charging roller to be restored.

It is a third object of the present invention to provide a restoration method for a charging roller in which the lifetime of the charging roller is not shortened even if there is an unevenness on the surface of the charging roller prior to restoration.

It is a fourth object of the present invention to provide a restoration method for a charging roller which is low in cost.

It is a fifth object of the present invention to provide a charging roller restored by the method of the present invention.

It is a sixth object of the present invention to provide a process cartridge installed in a charging roller restored by the method of the present invention.

Other objects will be apparent from the following descriptions.

The objects of the present invention can be achieved by restoration method comprising a step of loosely encasing a used charging roller in a seamless charging tube.

The charging roller restored according to the present invention is constituted of a conductive shaft, a conductive elastic cylinder, and at least one charging layer. The conductive elastic cylinder is integrally formed on the peripheral surface of the conductive shaft. Further, the charging layer is integrally provided on the peripheral surface of the conductive elastic cylinder. According to the present invention a used charging roller is restored by loosely encasing the charging roller in a seamless charging tube.

In a preferred embodiment of the present invention, the charging roller is loosely encased in the seamless charging tube for restoration after a cleaning process has been performed on the surface of the charging roller to which dust has adhered. As to the cleaning process, there are several methods, for example, a method wherein air blowing or an organic solvent is used, and an abrasion method.

When the charging roller restored by the present invention is used for a long time, the seamless charging tube is gradually deteriorated. Such a charging roller may be restored again according to the present invention, i.e., by replacing the deteriorated seamless charging tube with a new one. According to the present invention, the charging roller may be similarly restored repeatedly.

In another embodiment of the present invention, it is possible to restore a charging roller which has been restored by integrally and tightly covering it with a new charging layer by a method as stated, for example, in the Publication No. 8-171259. In other words, according to the present invention it is possible to restore a charging roller having two charging layers.

In the other embodiment of the present invention, the deteriorated charging layer of a charging roller is peeled off to expose the conductive elastic cylinder. This exposed elastic cylinder is loosely encased in the seamless charging tube.

According to the present invention, the charging roller may be restored repeatedly. Further, restoration may be performed without using an organic solvent. Thus, there are advantages with respect to economical use, easy restoration, and the environment.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PRESENT INVENTION

Figure 3:
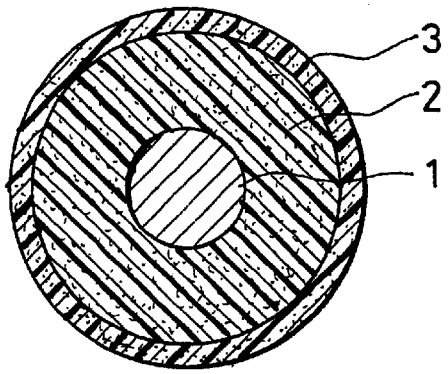
FIG. 3 (PRIOR ART)
FIG. 3 is a sectional view showing a conventional charging roller.
Figure 4:
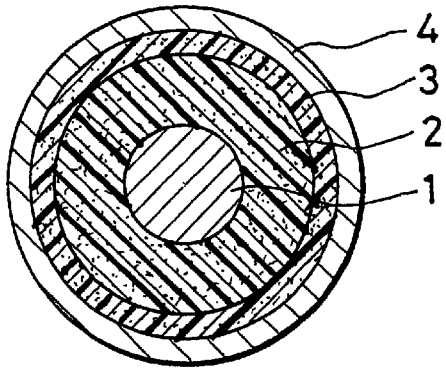
FIG. 4 (PRIOR ART)
FIG. 4 is a sectional view showing the charging roller shown in FIG. 3 restored by a conventional method.

A charging roller to be restored by the present invention is a conventional one shown in FIG. 3 as an example which is disclosed in Japanese Patent Laid-Open Publication No. 8-171256, for example. In brief, a conductive elastic cylinder 2 is integrally formed on the peripheral surface of a conductive shaft 1. Further, a charging layer 3 is integrally provided on the peripheral surface of the elastic cylinder 2. In the present invention, charging cannot be substantially performed only by a shaft having a conductive elastic cylinder thereon, but can be performed after further providing a charging layer thereon.

As to the conductive shaft, a metal (e.g., iron, nickel plated iron, stainless steel, aluminum, etc.) shaft isused. Besides this, it is possible to use a shaft made of insulating material and having a metal plated on the surface thereof, a shaft made of conductive resin, and so forth. In general, a commercially available conductive shaft has a diameter of about 6 mm for A4 and letter size and 8 to 9 mm for A3 size.

The conductive elastic cylinder is made of a conductive elastic material, and there are a solid-state type and a foam-state type. It is provided on the shaft, for example, by forcibly fitting the shaft into a conductive elastic foam cylinder. The thickness of the conductive elastic cylinder is usually about 2 to about 4 mm, preferably about 2.5 to 3.5 mm, and the volume resistivity is usually about $10^4$ to about 109 Ωcm, preferably about $10^5$ to about $10^8$ Ωcm.

The charging layer is made of resin or rubber (e.g., polyamide, polyurethane, polyester, polystyrene, an elastomer of these, EPDM, etc.)

The charging layer can be obtained by coating a liquid composition containing the resin on the peripheral surface of the conductive elastic cylinder and drying. In the other way, the charging layer is produced by the following method. A seamless charging tube is formed using the above described resin or rubber material having a predetermined electric resistance. The inner diameter of the tube is made to be smaller than the conductive elastic cylinder. The cylinder is forcibly fitted into the seamless charging tube. In another method, a seamless charging tube made of the resin or rubber material is adapted to have heat shrinkability. The cylinder is inserted into the tube and is tightly covered by the tube through a heating process to form a charging layer thereon. Meanwhile, the charging layer may be provided as two covering layers. The thickness of the charging layer usually ranges from about 5 $\mu$m to about 1 mm. The resistivity of the charging layer usually ranges from about $10^4$ to about $10^{10}$ Ωcm.

The above-described charging roller is installed in a process cartridge to perform printing until the toner inside the process cartridge is consumed. After that or when image deterioration has occurred, the charging roller is dismantled from the process cartridge to subject it to restoration. Parts of the process cartridge are inspected, and if necessary, cleaning is performed. In the present invention, if toner particles adhere to the surface of the charging roller, cleaning may not be performed. In that case, the charging roller is loosely encased in the seamless charging tube having an inner diameter larger than the outer diameter of the charging roller. In this way, a new charging roller is formed and can be installed in the process cartridge. In other words, the used charging roller is restored and is employed again.

When a considerable amount of toner particles adhere to the charging roller, image characteristics are adversely affected if the above-described conventional reproducing method is used. Further, when there is a damaged portion (for example, a concave having a size of about 0.1 mm or more) on the surface of the charging roller, image characteristics a real so affected adversely if the conventional restoration method is used. However, according to the present invention, the image is not affected under the above conditions.

Figure 1:
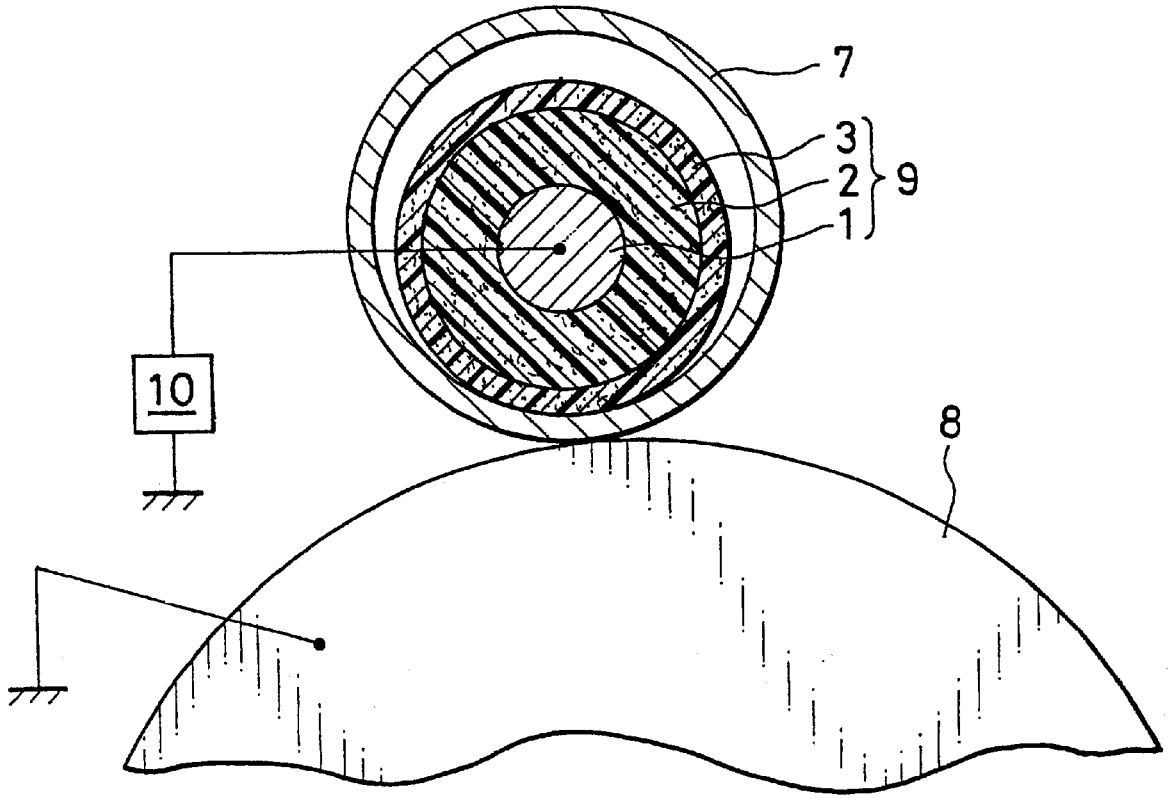
FIG. 1 is a sectional view of a part of an electrophotographic apparatus using a charging roller restored by a method according to the present invention.

In FIG. 1 a used charging roller 9 is constituted of a conductive shaft 1, a conductive elastic cylinder 2, and a charging layer 3. As stated above, the used charging roller 9 is loosely encased in a seamless charging tube 7 to restore it. The seamless charging tube 7 and the used charging roller 9 rotate in association with the rotation of a photosensitive drum 8. A voltage is applied with a power circuit 10 between the shaft 1 and a photosensitive drum 8. In this way, the outer surface of the photosensitive drum 8 is charged. A negative terminal of the power circuit 10 is connected to the conductive shaft 1 via a brush (not shown), and a positive terminal thereof is connected to a metal core (not shown) of the photosensitive drum 8 via a brush (not shown). Incidentally, the voltage may be a superposition voltage of a DC voltage and an alternating voltage, instead of the DC voltage.

Figure 2:
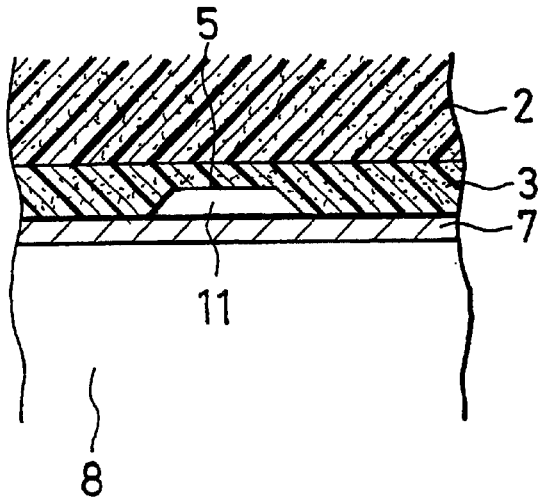
FIG. 2 is an enlarged sectional view showing a peripheral portion of a part of the charging roller restored by the method of the present invention.
Figure 5:
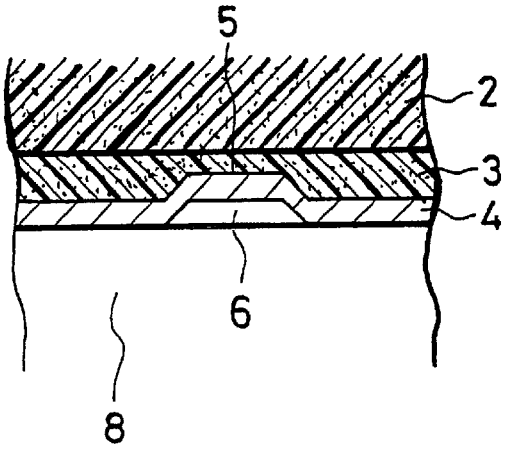
FIG. 5 (PRIOR ART)
FIG. 5 is an enlarged sectional view showing a peripheral portion of a part of the charging roller shown in FIG. 4 restored by the conventional method.

FIG. 2 is a drawing corresponding to FIG. 5 with respect to its irregular portion and showing the charging roller restored by the method according to the present invention. FIG. 2 partially shows a state in which the restored charging roller is pressed against the photosensitive drum 8. Even if a damaged portion 5 is present on the original charging layer 3, the seamless charging tube 7 is not deformed to the shape of the damaged portion because the charging tube 7 is not thermally shrunk. Thus, since any concave portion as shown in FIG. 5 does not exist between the photosensitive drum 8 and the seamless charging tube 7, uneven charging is not caused. The concave portion 11 only exists between the seamless charging tube 7 and the original charging layer 3. In FIG. 2 regarding a region of the seamless charging tube 7 corresponding to the concave portion 11, an electric current flows thereto from around the concave portion 11. Owing to this, uneven charging is not caused despite the existence of the concave portion 11.

In case conspicuous dirt is found on the surface of the charging roller 9 upon inspecting the parts, it is desirable to remove the dirt through a cleaning process. Preferably, an air blowing is carried out first. In case a developing agent adheres in a comparatively wide area so strongly as cannot be removed by air blowing, the adherent materials may be removed with a cloth, a tissue, etc. having adsorbed therein an organic solvent such as an alcohol or a ketone. Even if the adherent materials are not perfectly removed, an image printed with the thus restored charging roller is not affected in the present invention. On the contrary, a pattern of the adherent materials appears in the image if a charging roller restored by conventional method is used, especially under a condition of low humidity. Meanwhile, when the surface of the charging layer is severely damaged during usage, toner particles enter the damaged portion and reduce the charging ability of the damaged portion. Thus, a pattern of the damaged portion appears in the image. However, in such a case by loosely encasing the charging roller in a seamless charging tube according to the present invention, charging can uniformly be performed as described above, whereby the pattern of the damaged portion does not appear in the image.

When the adherent material cannot be removed with an organic solvent, it may be removed by an abrading process using an abrading material such as a sandpaper, a sandcloth, a sponge including an abrasive dispersed therein, a wire brush, and so forth, or by a sandblasting technique. By abrading, the surface of the charging roller besides the adherent material is also abraded and scratches may be formed thereon. However, by loosely encasing the charging roller in the seamless charging tube, a pattern of the scratch does not appear in a printed image. When the particle size of the abrasive is small, it is natural that the pattern of the scratch hardly appears in the image. It was surprising that in the present invention, however, even if the particle size of the abrasive was large and a conspicuous scratch occurred, the pattern of the scratch did not appear in the image. According to the present invention it was confirmed that uniform charging could be performed even if the scratch caused by the abrasion had a depth and/or width of about 0.1 to about 0.5 mm.

For example, when abrading is performed with a sandpaper having a roughness of No. 800, the scratch is hardly recognized. Thus, the pattern of the scratch does not appear in the image even if charging is carried out without using the seamless charging tube. In this case, however, since the abrading ability of the sandpaper is low it takes a lot of time for abrading. On the other hand, when a sandpaper having a roughness of No. 80 is used, its abrading power is so great that the adherent material is completely removed by two or three time abrasion. In this case, however, a conspicuous scratch occurs on the surface. Thus, if charging is carried out without using the seamless charging tube, the pattern of the scratch appears in the image. On the other hand, the pattern of the scratch does not appear when charging is carried out using the seamless charging tube according to the present invention. Abrading may be performed by using a wire brush or the like instead of sandpaper. A sandblasting technique can also be used.

In the restoration process for the charging roller, the cleaning step using an organic solvent may be omitted to directly execute the abrasion using a sandpaper or the like. By omitting the cleaning step, the influence of the organic solvent on the environment can be prevented.

The inner diameter of the seamless charging tube should be larger than the outer diameter of the charging roller. In point of fact, however, when the charging roller is encased in the seamless charging tube (i.e., the charging roller is inserted into the seamless charging tube), smooth insertion is likely to be disturbed by coming into contact with each other. In view of this, it is preferable to provide a diameter difference of about 0.05 mm or more, preferably about 0.1 mm or more and most preferably about 0.2 mm or more. In the actual charging device, the upper limit of the diameter difference depends on the space for containing the charging roller. If there is a considerable space, the diameter difference may be 2 mm or more. Almost all of the actual charging devices have an upper limit of about 2 mm for the diameter difference. In case the seamless charging tube has a too large diameter, there is a possibility that the seamless charging tube will contact a part of the charging device. When toner particles in a developing agent remain on the surface of the charging roller to be restored, the charging roller is smoothly inserted into the seamless charging tube since the toner particles function as a solid lubricant.

The seamless charging tube should have a thickness such that the sectional shape thereof is roughly a circle by itself. Although the thickness depends on rubber hardness, it is preferable to be about 50 $\mu$m or more, more preferably to be from about 75 $\mu$m to 300 $\mu$m, and most preferably from about 100 $\mu$m to about 300 $\mu$m.

The thickness may be greater than about 300 m. However, in that case, the material of the seamless charging tube is merely wasted. The rubber hardness of the charging tube is preferably within a range of about 30 to 70 degrees in Asker C hardness, and more preferably within a range of about 40 to 65 degrees.

The electric resistance of the seamless charging tube should be roughly the same as that of the charging layer of the charging roller to be reproduced. The volume resistivity is desirably within a range of from about $5\times10^4$ to about $10^{10}$ $\Omega$cm, more preferably about $10^6$ to about $10^8$ $\Omega$cm.

As to the material of the seamless charging tube, it is appropriate to use a resin elastomer of a polyester, a polyamide, a polyurethane, etc. or a modification thereof in view of economy, ease of obtaining, and so forth. However, these materials are not exclusive. It is possible to use those described as materials of the charging layer in the above-mentioned Publication No. 8-171259.

The seamless charging tube is produced by an extrusion method or inflation method using a resin elastomer or a modified material containing conductive fine particles of one or more kinds dispersed therein. As the conductive fine particle, carbon black is generally used. It is also possible to use stannous oxide, titanium oxide, zinc oxide, copper, silver, etc.

In the present invention, the seamless charging tube 7 is rotated in association with the movement of the member to be charged, usually, in association with the rotation of the photosensitive drum 8. Moreover, in association with the rotation of the seamless charging tube 7, the charging roller 9 is rotated. In the present invention, since the seamless charging tube 7 has a diameter different from that of the charging roller 9 the contact portion of them shifts little by little during the associated rotation. Therefore, even if deterioration of the seamless charging tube 7 is caused due to the uneven surface of the charging layer 3, the deterioration is not concentrated at the same position on the charging tube, that is, it is distributed circumferentially, and it hardly affects the life of the seamless charging tube. In accordance with this, the life of the photosensitive drum is also less affected by such unevenness of the charging layer 3.

EXAMPLE 1

Conductive carbon was compounded into EPDM (ethylene propylene diene methylene) polymer to make a polymer having a volume resistivity of $10^4$ $\Omega$cm. A foaming agent and a vulcanizing agent were added in the above EPDM composition, and it was formed into a cylindrical shape by extrusion. Further, the cylindrical product was heated to obtain a cylinder of conductive foam having an inner diameter of 4 mm and an outer diameter of 14 mm. The conductive foam cylinder was cut, perpendicularly to its longitudinal direction, into a length of 225 mm, and was inflated by air to insert therein a stainless steel shaft having a diameter of 6 mm and a length of 250 mm. Subsequently, the outer surface of the conductive foam was abraded to form a conductive cylinder having an outer diameter of 12.5 mm. The Asker C hardness of the conductive foam was 35 degrees. Meanwhile, a polyamide elastomer in which conductive carbon was compounded to provide a semiconductive polymer was formed into a tube shape by extrusion. After that, the tube-shaped product was stretched to obtain a seamless charging tube having an inner diameter of 13.5 mm and a thickness of 100 $\mu$m. The volume resistivity of this tube was $1.5\times10^6$ $\Omega$cm . The seamless charging tube was cut into a length of 227 mm, and then the elastic conductive cylinder obtained above was covered with this tube. Subsequently, heating was performed at 100° C. for two minutes. The tube was thermally shrunk to integrally cover the conductive elastic cylinder. A charging roller having an outer diameter of 11.6 mm was thus obtained.

The thus obtained charging roller was set in a process cartridge for an electrophotographic printer, and the process cartridge was set in a printer for evaluation. Inside the process cartridge, a photosensitive drum was installed. Further, a developing unit and a cleaner unit were provided around the photosensitive drum. A superposition of direct current voltage of −700 V and an alternating voltage having a frequency of 600 Hz and a peak to peak voltage of 1,700 V was applied to the shaft of the charging roller. Printing tests of 3,500 A4 size pages were respectively performed under normal conditions (23° C., 55% RH), a high temperature/high humidity condition (32° C., 80% RH), and a low temperature/low humidity condition (15° C., 10% RH). In total, 10,500 pages were printed. As a result, in all cases conducted under these conditions, any change of image qualities was hardly discernible at the end of each test in comparison with those at the beginning of the test.

The charging roller was inspected after being detached from the process cartridge, and it was found that toner particles uniformly adhered to the surface of the charging roller. Almost all of the toner particles were blown off by air blowing. This charging roller was restored in the following manner. A semiconductive polymer composition containing a polyamide elastomer and conductive carbon particles, was formed into a tube-like shape by extrusion to obtain a seamless charging tube having an outer diameter of 12 mm and a thickness of 150 $\mu$m. This tube-shaped product was cut into a length of 230 mm, and loosely encased the used charging roller. The charging roller thus restored was set in another process cartridge. This process cartridge was set in the printer described above to execute a printing test. The results obtained were substantially the same as those obtained above using the original charging roller.

EXAMPLE 2

The same experiments as those in Example 1 were performed, except that the air blowing step was omitted. Substantially the same results as those obtained in Example 1 were obtained.

EXAMPLE 3

After the printing tests were executed by using the charging roller restored in Example 1, the charging roller was taken out of the process cartridge. Then, the seamless charging tube was replaced with an unused seamless charging tube the same as used in Example 1. The charging roller restored again was set in a new process cartridge, and the process cartridge was set in the foregoing printer. Substantially the same results as in Example 1 were obtained.

EXAMPLE 4

A charging roller was produced using a heat-shrinkable tube the same as used in Example 1 except that the volume resistivity thereof was $10^5$ Ωcm. The charging roller was set in a process cartridge the same as used in Example 1, and this process cartridge was set in the foregoing printer to execute a printing test under normal conditions. When a black streak began to appear in the image after printing of 15,000 pages, the process cartridge was detached to inspect the charging roller. One streak, which was regarded as deterioration caused by electric discharge, was seen on the surface of the charging roller in a circumferential direction. Since the streak portion could not be removed with ethyl alcohol or methyl ethyl ketone it was removed by softly abrading with a sandpaper (No. 120). Subsequently, dust on the surface was removed by air blowing. After that, the charging roller was loosely encased in the seamless charging tube the same as used in Example 1 to obtain a restored charging roller having an outer diameter of 12 mm. The thus restored charging roller was set in a process cartridge the same as used in Example 1 and printing was conducted in the same manner as above in this Example. As a result, it was confirmed that unevenness did not appear on an image.

EXAMPLE 5

The restored charging roller tested in Example 4 was taken out of the process cartridge, and the seamless charging tube was detached. After that, the heat-shrunk charging layer tightly covering the conductive elastic cylinder was peeled off. A peeling operation was performed as follows. First, the charging layer was cut with a sharp knife from one end thereof to the other end thereof in the longitudinal direction. Then the end of the charging layer was turned over. The charging layer could be continuously peeled from the end thereof. There were portions where the tip of the knife reached the conductive elastic cylinder. Furthermore, since the charging layer partially adhered to the surface of the conductive elastic cylinder, several portions of the surface of the conductive elastic cylinder were removed with the peeled charging layer. The conductive elastic cylinder exposed in this way was loosely encased in the seamless charging tube the same as that in Example 1, to obtain a new charging roller. This charging roller was tested in the same manner as in Example 1, and substantially the same results as in Example 1 were obtained. It was confirmed that although there were cut portions on the surface of the conductive elastic cylinder that were made by cutting with the knife to peel off the charging layer and several portions of the surface were removed at the time of peeling, there was not any influence on the printed image.

Japanese Patent Laid-Open Publication No. 5-273844 discloses a charging member in which a conductive foam cylinder is integrally provided around a conductive shaft, and this conductive foam cylinder is loosely encased in the seamless charging tube. However, the object of the invention of the Publication No. 5-273844 is to reduce charging noise, and the Publication teaches producing a new charging roller but does not teach to restore a used charging roller.

The method for producing a charging roller in the Publication is different from the method for restoring the charging roller in the present invention.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as being included therein.

What is claimed is:

1. A restoration method for a used charging roller having a conductive shaft, a conductive elastic cylinder integrally formed on the peripheral surface of said conductive shaft, and at least one charging layer integrally provided on the peripheral surface of said conductive elastic cylinder, said method comprising:

loosely encasing said charging roller in a seamless charging tube having an inner diameter larger than the outer diameter of said charging roller.

2. A restoration method for a charging roller according to claim 1, further comprising:

cleaning a surface of said charging roller prior to loose encasement of said seamless charging tube on said charging roller.

3. A restoration method for a charging roller according to claim 2, wherein cleaning said surface of said charging roller is performed by air blowing.

4. A restoration method for a charging roller according to claim 2, wherein cleaning said surface of said charging roller is performed with an organic solvent.

5. A restoration method for a charging roller according to claim 4, wherein said organic solvent is either of an alcohol and a ketone.

6. A restoration method for a charging roller according to claim 2, wherein cleaning said surface of said charging roller is performed by abrasion.

7. A restoration method for a charging roller according to claim 6, wherein said abrasion is carried out with sandpaper.

8. A restoration method for a charging roller according to claim 1, wherein the number of said charging layers is two.

9. A restoration method for a charging roller according to claim 1, further comprising:

exposing said conductive elastic cylinder by peeling off said charging layer of said charging roller prior to loose encasement of said seamless charging tube on said charging roller.

10. A restoration method for a charging roller according to claim 1, further comprising:

after subjecting said restored charging roller to charging until the seamless charging tube is deteriorated, replacing the deteriorated seamless charging tube with a new one.

11. A restoration method for a charging roller according to claim 10, wherein said restoration is conducted repeatedly after each charging.

12. A charging roller restored by a method comprising loosely encasing a used charging roller in a seamless charging tube having an inner diameter larger than the outer diameter of said used charging roller, said charging roller having a conductive shaft, a conductive elastic cylinder integrally formed on the peripheral surface of said conductive shaft, and at least one charging layer integrally provided on the peripheral surface of said conductive elastic cylinder.

13. A charging roller restored according to claim 12, wherein the difference of said inner diameter of the seamless charging tube and the outer diameter of the used charging roller is not more than 2 mm.

14. A charging roller restored according to claim 12, wherein the difference of said inner diameter of the seamless charging tube and the outer diameter of the used charging roller is not less than 0.05 mm.

15. A charging roller restored according to claim 12, wherein said seamless charging tube has a circular sectional shape.

16. A charging roller restored according to claim 12, wherein the thickness of the seamless charging tube is not less than 50 $\mu$m.

17. A charging roller restored according to claim 16, wherein the thickness of the seamless charging tube is within a range of from 75 to 300 $\mu$m.

18. A charging roller restored according to claim 17, wherein the thickness of the seamless charging tube is within a range of from 100 to 300 $\mu$m.

19. A charging roller restored according to claim 12, wherein the hardness of the seamless charging tube is within a range of from 30 to 70 degrees Asker C Hardness.

20. A charging roller restored according to claim 19, wherein the hardness of the seamless charging tube is within a range of from 40 to 65 degrees Asker C Hardness.

21. A charging roller restored according to claim 12, wherein the electric resistance of the charging tube is roughly the same as that of the charging layer.

22. A charging roller restored according to claim 12, wherein the volume resistivity of the seamless charging tube is in a range of from $5\times10^4$ to $10^{10}$ Ωcm .

23. A charging roller restored according to claim 22, wherein the volume resistivity of the seamless charging tube is in a range of from $10^5$ to $10^8$ Ωcm .

24. A charging roller restored according to claim 12, wherein the material of the seamless charging tube is selected from the group consisting of a resin elastomer of a polyester, a polyamide, a polyurethane and a modified material thereof.

* * * * *